United States Patent [19]

Morane

[11] Patent Number: 4,720,046

[45] Date of Patent: Jan. 19, 1988

[54] PRESSURIZED CONTAINER FOR DISCHARGING, IN A CONTROLLED FASHION, AN IMPROVED QUALITY MOUSSE

[75] Inventor: Bruno P. Morane, Neuilly, France

[73] Assignee: 'L'Oreal', Paris, France

[21] Appl. No.: 815,034

[22] Filed: Dec. 31, 1985

[30] Foreign Application Priority Data

Dec. 24, 1985 [FR] France ..... 85 19133

[51] Int. Cl.[4] ..... B05B 1/14

[52] U.S. Cl. ..... 239/343; 222/190; 239/553.3

[58] Field of Search ..... 239/343, 552, 553.3, 239/590.3, 590.5, 553, 553.5; 169/14, 15; 222/189, 190, 402.13

[56] References Cited

U.S. PATENT DOCUMENTS

| | | | |
|---|---|---|---|
| 2,492,037 | 12/1949 | Freeman et al. | 169/15 |
| 2,571,871 | 10/1951 | Hayes . | |
| 2,577,025 | 12/1951 | Lundberg | 239/343 |
| 2,829,874 | 4/1958 | Freeman | 239/590.3 |
| 3,094,171 | 6/1963 | Gagliardo | 239/343 |
| 3,122,284 | 2/1964 | Miles . | |
| 3,333,744 | 8/1967 | Nilsen et al. | 222/402.13 |
| 3,672,546 | 6/1972 | Ruhle | 222/402.12 |
| 3,954,207 | 5/1976 | Brill . | |
| 4,509,661 | 4/1985 | Sugizaki et al. | 222/190 |

FOREIGN PATENT DOCUMENTS

| | | | |
|---|---|---|---|
| 2456651 | 6/1975 | Fed. Rep. of Germany | 222/402.13 |
| 1255509 | 1/1961 | France . | |
| 2179590 | 11/1973 | France . | |
| 2195916 | 3/1974 | France | 239/343 |
| 2453790 | 12/1980 | France | 222/402.13 |
| 193523 | 2/1923 | United Kingdom . | |
| 2024049 | 1/1980 | United Kingdom . | |

*Primary Examiner*—Andres Kashnikow
*Assistant Examiner*—Michael J. Forman
*Attorney, Agent, or Firm*—Cushman, Darby & Cushman

[57] ABSTRACT

The container comprises a distribution valve having disposed on its outlet orifice, a push button (14) cooperating with the valve to produce discharge of the mousse. The discharge channel (24) opens in a mousse accumulation chamber (28), in which the entering flow of the mousse is deflected by a deflector (36) before escaping towards the exterior through a grill (27) constituting the end wall of the said chamber (28), substantially opposite to said ejection channel (24). This arrangement permits the control of the discharge of the mousse, which leaves in a compact manner, presenting a much greater fineness of texture, with a much greater ability to be applied.

9 Claims, 3 Drawing Figures

PRESSURIZED CONTAINER FOR DISCHARGING, IN A CONTROLLED FASHION, AN IMPROVED QUALITY MOUSSE

The present invention relates to pressurised containers of the "aerosol bomb" type, used for packaging and distribution of foaming products, these containers being provided with a distribution valve permitting their use, by acting on a push button associated with the valve, to provoke the discharge of the product to be distributed in the form of a mousse.

The foaming products capable of being thus distributed in the form of mousses, from containers of the said type, are, at the present time, cosmetic and keep fit products. In the field of the care of the body and the hair, one can cite pressurised packaging cans of foaming shaving creams, of hair dyes, of cold permanent waving compounds, of shampoos, of depilatories, of make-up removing mousses, of "bubble baths" etc.

The present invention can be applied to the distribution of mousses in the cosmetic field, but it is not at all limited to this field.

One major difficulty with the distribution of mousses from pressurised containers is that the mousses are ejected from these containers through an orifice of small dimensions and that the mousse, in escaping from this orifice, has a tendency to fall down at least partially from the distribution head of the container.

If one wishes to avoid the difficulties in the object of obtaining a correct distribution of the product, directly from the outlet of the pressurised container, on the surface, on which it is destined to be applied, one finds the solution in U.S. Pat. No. 3,672,546. According to the latter, it is possible, in effect, to fit on the discharge tube emerging from the distribution head carrying the push button for the control of the valve, a nozzle in the form of a hollow or of a cone, on the extreme edge of which is applied a grill. This grill permits the distribution of the mousse as it leaves, the nozzle then serving as an applicator.

The applicants, however, search for a solution to another problem which is posed in the case of the distribution of mousses leaving pressurised containers, this problem being to perfect the texture of these mousses in particular to render them finer, and, in consequence, more capable of being applied on their support, which is designated or denoted hereafter by the expression "packaging of the mousse". During this search, the applicants have discovered that if one induces expansion of the mousse, at the outlet of the pressurised container, in a chamber called an accumulation chamber, and one places, in this chamber, in the path of flow of the pressurised container, a deflector inducing a deviation of the mousse during movement through the space of this chamber, before the discharge through the grill, the rheology of the mousse is, in a surprising fashion, modified in the desired sense. At the same time, perfect control of the discharge of the mousse, in the sense that by a pressure applied on the push button one produces a block of mousse which bursts past the grill, without collapsing on the distribution head of the container. There results, therefore, a supplementary advantage to simplification, for the user, the ability to collect the mousse before applying it.

In one preferred embodiment of the present invention, the accumulation chamber is defined by a lateral wall having the form of an assembly with a very divergent cone of small height, the dimension of the grill being much larger than that of the obstacle, which is disposed in the vicinity of the entry orifice of the mousse in the said accumulation chamber.

However, according to the invention, it is advantageous that the accumulation chamber should form part of a fixed nozzle adaptable directly on the distribution head of the pressurised container, this distribution head cooperating, in a normal fashion, with the discharge valve, of the container and the valve should be or not an emergent stem.

The present invention has, for its object, a pressurised container for packaging a foaming product and its controlled distribution in the form of a mousse of an improved quality, the distribution valve being disposed on the outlet orifices of the container, push button cooperating with the said valve to induce discharge of the said product through an discharge channel, characterised by the fact that the channel opens in an accumulation chamber for the mousse, the interior of which has disposed, in the vicinity of the orifice by which said canal opens into the said chamber, a deflector intended to impede the entering flow of mousse, the said chamber comprising, essentially opposite the said orifice and facing the latter, an end wall constituted by a grill.

Preferably, the accumulation chamber presents a surface of revolution with respect to an axis which, in the mounted position of the container, is coaxial with the axis of the mousse entering the said chamber.

According to an important characteristic of the present invention, the deflector and the grill are flat elements, disposed substantially perpendicular to the axis of flow of the mousse entering the said accumulation chamber.

According to one preferred embodiment, this latter is defined by a lateral wall diverging towards the exterior, the opening defined by the outer edge of the said lateral wall being closed by the grill.

The latter advantageously presents a surface very slightly larger than that of the orifice by which the discharge canal opens into the accumulation chamber. According to another characteristic of the grill, the latter presents an optical frontal transmission comprising between 20 and 60% and a mean diameter of opening of the mesh comprises between 0.7 and 1.1 mm. Moreover, the grill can constitute a fixed element maintained in place by a collar snap fitted around the outer edge of the fixed wall defining the accumulation chamber.

The deflector presents, at this part, preferably a surface almost equal to that of the orifice through which the outlet channel opens into the accumulation chamber. The deflector can be supported by one (or more) element(s) of the wall defining the accumulation chamber.

According to another characteristic of the present invention, the distance separating the grill from the deflector, is close to the distance separating the deflector from the orifice by which the discharge channel opens into the accumulation chamber.

Preferably, the discharge channel should be oriented obliquely towards the top with respect to the axis of the container.

In the case where the discharge channel is defined by a tube opening from the distribution head adapted on the said container, and comprising a push button, the mousse accumulation chamber is advantageously defined at the interior of a fixed nozzle carrying, at its opposite end to the grill, a sleeve permitting the adaptation of the said nozzle on the said tube.

To better understand the object of the present invention, one now describes by way of purely illustrative and non-limitative example, an embodiment shown on the attached drawing.

Figure 1:
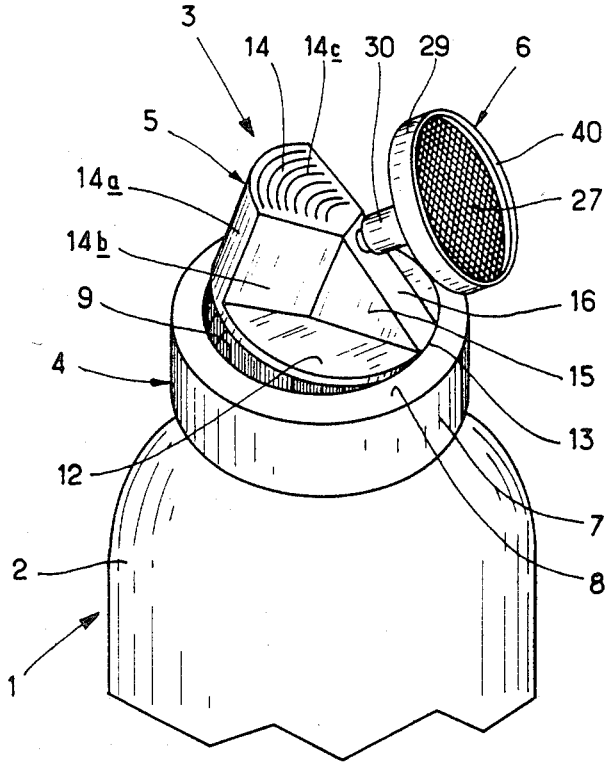
FIG. 1 is a perspective view of the upper part of a pressurized container according to the present invention.

Referring to FIG. 1, one sees that there is designated by 1, in its entirety, a pressurised container of the "aerosol bomb" type in which is packaged a foaming shaving cream, which is intended to be distributed in the form of a mousse from the outlet of the container 1.

The latter comprises a body 2 having a lateral cylindrical wall, on the upper end edge of which is fixed, by means of crimping, a valve holding cup. In the central zone of the valve holding cup, is disposed a valve provided with an outlet discharge tube. The valve holding cup, the valve and its outlet tube, are not shown in the drawing, because they are of a conventional structure. If one depresses the discharge tube of the valve, one produces a flow to the outside air of the contents of the container, which is thus projected outside the latter, under the effect of the propulsion gas present in the container, with the simultaneous production of the mousse as a result of the presence, in the liquid phase, of a foaming product consisting of at least an appropriate surface active agent and of the partial dissolution of a propulsion gas in the said liquid phase at the interior of the container.

On the body (2), is positioned a distribution head (3), constituted by a fixed wall (4) and by a movable part (5), this latter receiving a mousse conditioning nozzle (6).

The fixed part (4) of the distribution head (3) is constituted by a peripheral cylindrical skirt (7) connected to a base (8) providing a central opening (9). In the mounted position of the distribution head (3), on the body (2), the base (8) overhangs the peripheral upper edge of the valve holding cup. The skirt (7) formed in the interior, in the vicinity of the free edge, the interrupted annular rim (10) which, in the mounted position of the head (3), snaps into the interior of a peripheral groove which results from the crimping operation of the valve holding cup on the lateral wall of the container body. The part (4) of the distribution head (3) also comprises several radial webs (11) connected to the skirt (7) and the base (8), the webs (11) being applied on the peripheral upper edge of the valve holding cup when one comes to ensure the fixing of the head (3) on the body (2).

The movable part (5) of the distribution head (3) is constituted by a stand (12) in the form of a disc, of a diameter slightly less than that of the opening (9), the said stand (12) being connected to the inner edge of the base (8) by a flexible hinge (13). The stand (12) carries exteriorly, opposite to the flexible hinge (13), a press button (14) constituting a projection delimited by a lateral external frusto conical wall (14*a*) two side walls (14*b*) which are substantially radial and an upper wall (14*c*) comprising striations to facilitate the application of the finger of the user, when he applies a pressure on the push button (14) to distribute the mousse.

The walls (14*b*) are extended by the walls (15) which are parallel to one another (FIG. 1), of which the height decreases progressively to the line of the flexible hinge 13. These walls (15) are joined by a rectangular oblique wall (16) of which the base is defined by the flexible hinge (13). The stand (12) provides, in its interior face, three apertures which open, the first into a hollow zone (17) defined by the walls (14*a*, 14*b* and 14*c*) of the push button (14), the second, in the axial channel (18), and the third, in the hollow zone (19) defined by the walls (15 and 16). The axial channel (18) is defined by a cylindrical wall (20) of which the internal edge (21) is chamfered and which extends, after an internal annular shoulder (22), by a smaller diameter (23) in which opens the axial channel (24) of a tube (25) passing through the said wall (16), in the upper part and projecting towards the exterior with respect to the said wall (16).

The conditioning nozzle (6) is constituted by the assembly of a flange (26) and of a grill (27) defining between them a mousse accumulation chamber (28).

The grill (27) is assembled on the flange (26) by a peripheral collar (29).

The flange (26) is constituted by a cylindrical sleeve (30) which is diverging at one of its ends to constitute a flat wall (31) in the form of a crown providing a right angled bead (32) opposite the sleeve (30).

The latter has an interior diameter slightly greater than the exterior diameter of the tube (25), thus permitting the sliding of the conditioning nozzle (6) of the tube (25) with sufficient friction to ensure the maintenance in place of the said nozzle (6) on the distribution head (3).

The external cylindrical wall of the bead (32) forms a flange (33) towards the exterior, in the vicinity of the upper edge (34) which constitutes an annular bearing surface for the application of the grill (27). Moreover, the bead (32) is defined interiorly by a frusto conical wall (35) diverging opposite the sleeve (30).

Figure 3:
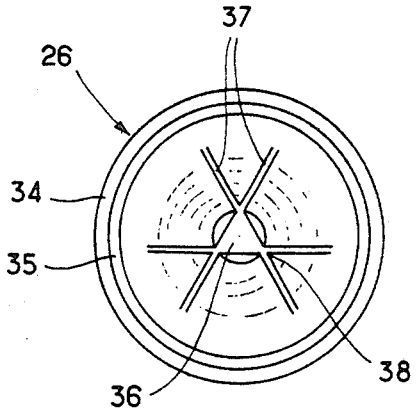
FIG. 3 is a plan view of the package equipping the distribution head of the container shown, the grill and the collar, which support the latter, having been removed.

Furthermore, the flange (26) of the nozzle (6) has interiorly, substantially in the same plane as the wall in the form of a ground (31) a deflector plate (36) in the form of an isosceles triangle, this plate (36) being carried by a wall (37) perpendicular to its plane and exterior to this, as a prolongation of each side of the triangle, as can be seen in FIG. 3. On FIG. 2, as represented by the reference numeral (38) is a junction of two associated walls (37) associated at an angle to the deflector plate (36). Between the three elements (38), one finds thus constituted openings for the passage of the mousse from the channel (24) of the tube (25) into the accumulator chamber (28) when the flange (26) is in place on the distribution head (3).

The grill (27) has a circular form. The form of the mesh is not critical. Advantageously, however, the grill (27) can have a percentage of opening between the wires of the grill of the order of 20 to 60% of the total surface of the grill.

The collar (29) is formed by a cylindrical wall (39) turned perpendicular to the interior of one of the ends of its end to constitute a rim (40) to maintain the grill (27) on its support. On the internal face of the wall (39), is provided an annular rim (41), intended to be applied under the flange (33), in the assembled position of the sleeve (29) on the flange (26). One can equally note that the interior edge of the wall (39) at the opposite of the rim (40), is chamfered in the manner to facilitate the putting in place of the collar (29). In fact, when one assembles the elements forming the conditioning head (6), one can slide the collar (29), over the head (32) of the flange (26) on which one has applied the grill (27). Due to the elasticity of the collar (29) and of the flange (26), the rim (41) is placed, as indicated above, behind the flange (33), position where the bead (40) is applied firmly on the grill (27).

One packages in the conventional manner, in the container (1), a foaming preparation comprising, in combination with the active material it is to distribute, a propulsion agent such as a hydrocarbon, in preference halogenated, to provide a liquid-vapour phase in equilibrium at the used temperatures under a relatively reduced pressure, of the order of a few bars.

One has compared the characteristics of the mousse obtained in the case of a discharge head (6) not being placed on the tube (25), and in the contrary case.

In the first case, the mousse ejected from the tube (25) practically immediately collapses, falling down on the wall (16) and on the base (8) of the fixed part (4) of the distribution head (3). It is thus inconvenient for the user to recover this mousse.

On the other hand, when the conditioning head (6) is in place, the mousse product shows a much better ridigity than was obtained previously; its trajectory is besides perfectly controlled, and one observes that the block of mousse of which one has been the discharged rests across the grill (27), as is shown schematically on FIG. 1. The user can withdraw this mousse in an extremely easy manner. Moreover, its texture is much finer, leading to a much better efficiency of its use. One notes that the discharge of the mousse is effected with little sputtering, without doubt due to the compactness of the mousse, of which the path is obstructed by the deflector plate (36), in the accumulation chamber (28).

One has, moreover, to search to evaluate in a quantitative manner, the difference of texture between the mousses distributed by a conventional pressurised container and by a pressurised container according to the invention. Two comparative original examples shown in evidence the important characteristics of the mousses which are distributed by the container according to the present invention are given hereafter.

1. FIRST EXAMPLE

A. Principle

In studying the instances of incidence of the presence of a mousse covering a support on the tangential resistance due to friction of a plate capable of sliding with respect to the support. One measures the force necessary to cause displacement of the plate, in using a mousse product with a distributor equipped with a discharge nozzle according to the present invention; one uses the same measures while using a mousse product with a conventional distributor and comparing the results obtained in the two cases.

B. Effecting the Measurement

On a carriage capable of being moved, one fixes a plate on which one forms a curve of 3 mm of the mousse to be studied. On this, one places a place of 7.7 g connected to a strain gauge capable of providing a signal of 10 volts for a force of 0.049N. The electronics associated with the strain gauge provide an analogue output which record the force and its evolution on a register. The register used provides sensitivity of 2.5 volts per 250 mm.

One moves the carriage, in one direction opposed to the strain gauge at a speed of 40 mm per minute and one notes, in each case, the value of the signal obtained.

C. Results

The results obtained are shown in the following Table I:

TABLE I

| Mousse product from a pressurised container | Signal obtained (volts) |
|---|---|
| Conventional | 1.70 (test 1) |
| | 1.66 (test 2) |
| According to the invention | 1.47 (test 1) |
| | 1.43 (test 2) |

The ratio of the value of the signal obtained in the case where the mousse was produced by the distributor of the invention, to the value of the signal obtained in the case where the mousse was obtained by a conventional distributor, is identical in the two tests which have been made, and rises to 0.86, giving a diminishing of the order of 14% (10 to 15%) of the force necessary to overcome the resistance due to friction when one utilises a mousse product with the apparatus equipped with the discharge nozzle according to the present invention. Such a result comes to corroborate the observations which have been made of a much more fine texture of the mousse produced with the discharge nozzle.

SECOND EXAMPLE

A. Description of the Mode of Operation Used

1. One fills a tube of 18 mm of interior diameter and 100 mm in height with the mousse to be studied. One places the vertical tube at a temperature of 25° C. and one puts on the mousse, a steel ball having a diameter of 10 mm. At the same time that one places the steel ball, one starts a chronometer which one stops when the ball arrives at the lower extremity of the tube.

B. Results

The results obtained are indicated in Table II hereafter:

TABLE II

Figure 2:
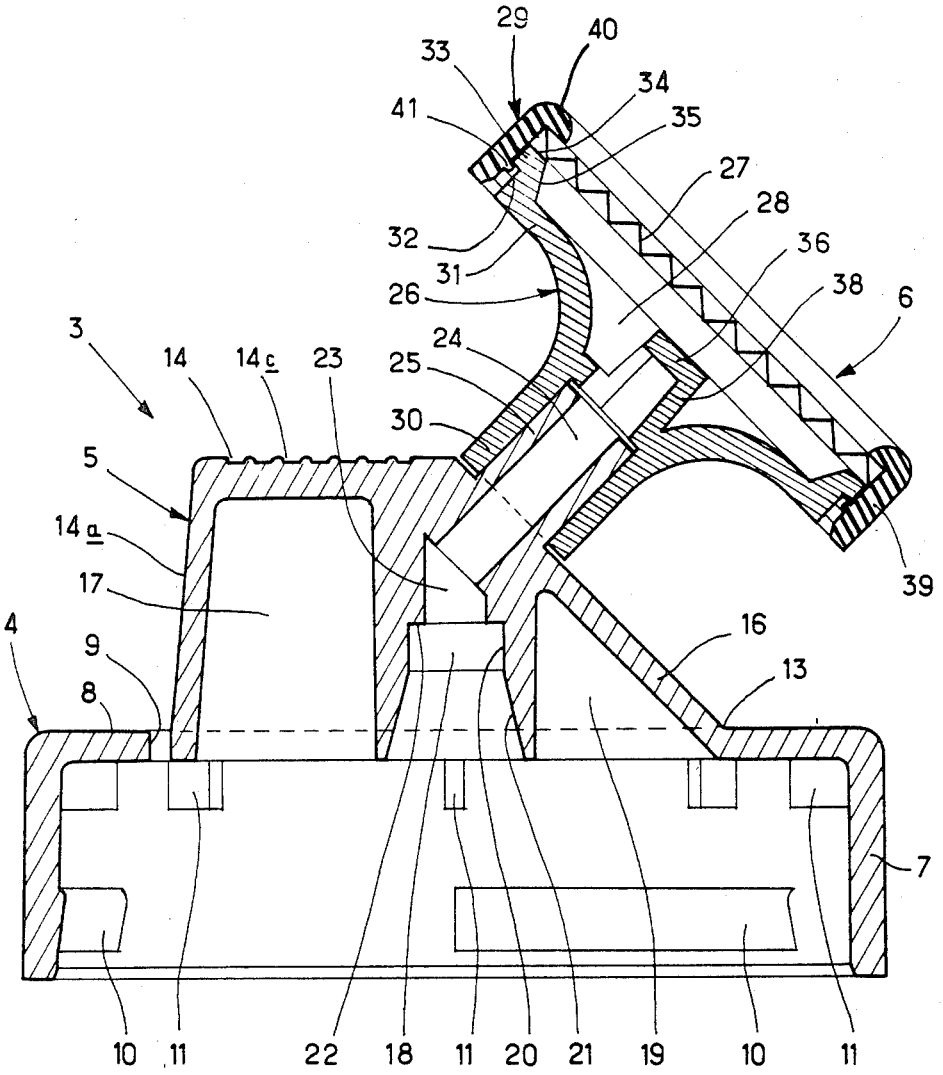
FIG. 2 is an axial sectional view of distribution head of the container of FIG. 1, according to a symmetrical plane of the said distribution head.

| Constituting Material | Grill Used Frontal Optical Transmission (%) | Mean Diameter of Openings of the Grid (mm) | Time of fall of the ball in a mousse obtained with the nozzle of FIG. 2 (in seconds) |
|---|---|---|---|
| Stainless No 1 | | | 60 |
| Stainless No 2 | 58 | 0.95 | 90 |
| Stainless No 3 | | | 55 |
| Aluminium No 1 | 55 | 1 | 65 |
| Aluminium No 2 | 25 | 0.85 | 75 |
| Aluminium No 3 | 34 | 0.55 | 95 |
| Aluminium No 4 | 48 | 0.8 | 51 |
| Mousse to be studied without any conditioning nozzle | | | 180 |

One sees that with the conventional mousse, the time of falling of the ball is 180 seconds whereas, if one utilises, for a container having a head according to the invention, of grills of different dimensions, one observes a variable falling speed, but which only attains at most 95 seconds. This experiment tends to show a greater aptitude of the mousse to be manipulated, due to its spreading on a surface, in the case where it has been produced by a distributor hair conditioning head according to the present invention. One understands that this property of the mousse is important, when utilising a shaving mousse, because of the greater aptitude for the mousse to be applied on the skin will result in a better quality of shaving.

It is well understood that the embodiment above described is not limitative and can be given many desirable modifications without departing from the scope of the invention.

I claim:

1. A pressurised container for packaging of a foaming product and its controlled distribution in the form of an improved quality mousse, said container comprising a container body; an outlet orifice of said body; a distribution valve placed on the outlet orifice; a discharge channel associated with said valve; push button means cooperating with the said valve effective to produce discharge of the said product through said discharge channel; a mousse accumulation chamber having an interior into which the discharge channel opens; a deflector located at said interior of said chamber, in the vicinity of the orifice by which said channel opens into the said chamber, said deflector having a surface disposed to obstruct the entering flow of the mousse, and an end wall constituted by a grill mounted on said chamber substantially opposite and facing the said orifice, said accumulation chamber being defined by a cylindrical sleeve serving as a base with said sleeve engaging and surrounding said discharge channel, said sleeve having an upper end which flares outwardly to an extremity to define a flared portion of the chamber and terminating in an annular flat wall portion lying in a plane, said deflector having an outer surface which lies substantially in said plane and an upstream wall in the flared portion of the chamber.

2. A container according to claim 1, wherein said discharge channel has a central axis and said accumulation chamber is formed by a surface of revolution with respect to said axis which, in a mounted position of the container extends in the direction of the flow of the mousse entering said chamber.

3. A container according to claim 1 wherein the deflector and the grill are flat elements, disposed substantially perpendicular to the direction of flow of the mousse entering the said accumulation chamber.

4. A container according to claim 1 wherein the accumulation chamber has an exterior and is defined by a lateral wall diverging towards said exterior and having an end edge, an opening defined by said end edge of the said lateral wall, said opening being covered by said grill.

5. A container according to claim 4 wherein the grill comprises a fixed element relative to said accumulation chamber and further comprising a collar snap fitted around the end edge of the wall defining the accumulation chamber effective to hold said grill in place.

6. A container according to claim 1 wherein the grill has a surface area very much greater than the cross-sectional area of the orifice by which the discharge channel opens into the accumulation chamber.

7. A container according to claim 1 wherein the grill has a plurality of intersecting wires spaced over a surface area with open spaces between said wires comprising between 20 and 60% of said surface area and a mean opening diameter of said open spaces comprises between 0.7 and 1.1 mm.

8. A container according to claim 1 wherein the deflector has a surface area almost equal to that of the cross-sectional area of said orifice by which the discharge channel opens into the accumulation chamber.

9. A container as claimed in claim 1 wherein said body has a fixed wall extending generally in a selected plane, said discharge channel being oriented to extend away from said fixed wall at an oblique angle.

* * * * *